US010100674B2

(12) United States Patent
Remy

(10) Patent No.: US 10,100,674 B2
(45) Date of Patent: Oct. 16, 2018

(54) RADIAL FIXING AND POSITIONING FLANGES FOR SHELLS OF AXIAL TURBINE COMPRESSOR HOUSINGS

(71) Applicant: Techspace Aero S.A., Herstal (Milmort) (BE)

(72) Inventor: Christophe Remy, Fexhe-le-Haut-Clocher (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 1371 days.

(21) Appl. No.: 14/081,511

(22) Filed: Nov. 15, 2013

(65) Prior Publication Data

US 2014/0133976 A1 May 15, 2014

(30) Foreign Application Priority Data

Nov. 15, 2012 (EP) ..... 12102848

(51) Int. Cl.
*F01D 25/24* (2006.01)

(52) U.S. Cl.
CPC ..... *F01D 25/243* (2013.01)

(58) Field of Classification Search
CPC ..... F01D 25/24; F01D 25/246; F01D 25/26; F01D 25/265; F01D 9/02; F01D 25/243
See application file for complete search history.

(56) References Cited

U.S. PATENT DOCUMENTS

| | | | | |
|---|---|---|---|---|
| 2,764,266 A * | 9/1956 | Haworth | F01D 5/066 285/187 |
| 5,183,223 A * | 2/1993 | Cornax | F02C 7/20 244/54 |
| 6,173,566 B1 * | 1/2001 | Boeck | F02C 7/04 415/213.1 |

FOREIGN PATENT DOCUMENTS

| | | |
|---|---|---|
| DE | 102009055614 A1 | 7/2010 |
| EP | 0123645 A3 | 10/1984 |
| EP | 1936125 A1 | 6/2008 |
| EP | 1939410 A1 | 7/2008 |
| EP | 1939459 A1 | 7/2008 |
| EP | 2077183 A1 | 7/2009 |

OTHER PUBLICATIONS

Search Report dated Apr. 19, 2013 for EP 12192848.

* cited by examiner

*Primary Examiner* — Woody Lee, Jr.
*Assistant Examiner* — Maxime Adjagbe
(74) *Attorney, Agent, or Firm* — James E. Walton

(57) ABSTRACT

The present application relates to an axial turbomachine housing designed to channel a primary annular flow in the low-pressure compressor of the said turbomachine. The housing comprises a first shell and a second shell designed to be contiguous and coaxial. The first shell comprises a flange and a centering surface substantially cylindrical. The second shell comprises a flange and radial centering member designed to mate with the centering surface. The flange of the first shell includes cut-outs distributed along its circumference, and the centering member extends axially from the flange of the second shell through the said cut-outs to the centering surface where the two flanges are in contact.

19 Claims, 3 Drawing Sheets

RADIAL FIXING AND POSITIONING FLANGES FOR SHELLS OF AXIAL TURBINE COMPRESSOR HOUSINGS

This application claims priority under 35 U.S.C. § 119 to European Patent Application No. 12102848.5, filed 15 Nov. 2012, which is incorporated herein by reference for all purposes.

BACKGROUND

1. Field of the Application

The present application relates to the housing of an axial turbomachine. More particularly, the present application relates to contiguous shells in the housing of an axial turbomachine. More particularly, the present application relates to fixing brackets between the shells in the housing of an axial turbomachine. The present application relates to the concentricity between two shells of a turbomachine fixed with radial flanges. The present application relates also to an axial turbomachine.

2. Description of Related Art

Turbomachines generally include a plurality of annular passages through which flows of air pass in order to generate a driving force. The airflow passes through a fan, a compressor, a combustion chamber, and turbines. In or between these elements, the housing of the turbomachine helps to guide the flow by constraining it within the turbomachine itself.

The housing is made up of annular walls mirroring the changes in section of the stream. To this end, it comprises shells having a generally tubular shape arranged along the engine's axis of rotation. The shells have functional surfaces in contact with the stream. They can form internal and/or external surfaces that physically define the stream. The shells may be cylinders or parts of cylinders. Where they join roughly forms a cylinder or the base of a cone of the desired length.

The functional surfaces of the shells must match as closely as possible the theoretical geometry of the airstream, in particular its continuity. This results in the requirement that the various shells must follow a general concentricity, without which steps or discontinuities may occur in the stream. These defects lead to a reduction in the efficiency of the turbomachine. Uncontrolled modes of operation can occur.

Patent EP123645 A1 discloses an assembly of two adjacent shells with flanges connected by axial screws for fixing them. One of the shells has a female cylindrical surface inside which a male cylindrical surface on the other shell is located, so as to form a shaft-bore assembly. The male and female cylindrical surfaces are located at the bases of the flanges. This type of assembly makes it possible to optimise the position and orientation of the shells relative to one another. However, the screws require an unobstructed locating surface. This surface may be greater than the inherent size of the screws to improve the distribution of mechanical stresses. The superposition of the cylindrical bearing face and the locating surface for the screw member that the radius of the outer flange has to be increased. The radius between the flange and the cylindrical bearing surface further increases the outer radius of the flange. This flange size is cumbersome and increases the weight of the shell. Such a radial flange can be difficult to implement in a splitter nose with a given lift/drag ratio. The presence of equipment in the nose may make it impossible to assemble.

Patent EP2077183 B1 discloses a junction between two shells of a turbomachine positioned with respect to each other using their flanges. These are located at the axial ends of the shells. The radial ends of the flanges have male and female surfaces. This solution allows optimum positioning while avoiding any constraints imposed by locating surfaces for screws. However, it requires a cylindrical portion at the top of one of the flanges, thereby increasing the radius of the latter.

Although great strides have been made in the area of housings for turbomachines, many shortcomings remain.

DETAILED DESCRIPTION OF THE PREFERRED EMBODIMENT

Figure 1:
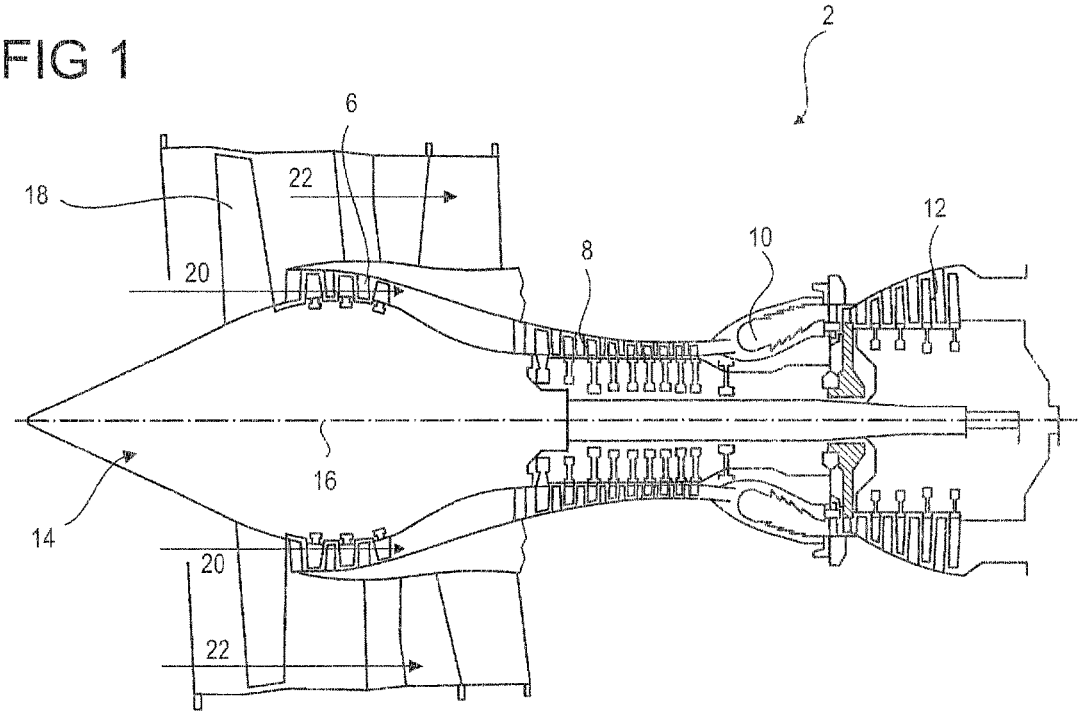
FIG. 1 shows a turbomachine in accordance with the present application.

The present application aims to solve at least one of the problems presented by the prior art. The present application aims to reduce the radius of the fixing flanges of the two shells of the housing of an axial turbomachine. The present application also aims to simplify the assembly of two shells of the housing of an axial turbomachine.

The present application relates to an axial turbomachine housing capable of directing an annular flow in the said turbomachine, the housing comprising a first shell and a second shell designed to be contiguous and coaxial, the first shell comprising a flange and a surface substantially cylindrical and the second comprising a flange and centering member designed to mate with the centering surface, wherein the flange of the first shell includes cut-outs distributed along its circumference and the centering member extends axially from the flange of the second shell through the said cut-outs to the centering surface where the two flanges are in contact.

According to an advantageous embodiment of the present application, the cut-outs of the flange of the first shell are scallop-shaped or openings.

According to yet another advantageous embodiment of the present application, the axial extension of the cut-outs intersects the centering surface.

According to yet another advantageous embodiment of the present application, the centering surface forms a thickened layer on the first shell.

According to yet another advantageous embodiment of the present application, the radius R2 of the centering surface is smaller than the radius R3 of the radial extremity of the flange on the first shell.

According to yet another advantageous embodiment of the present application, the first shell includes an annular bead adjacent to the flange of the first shell, the centering surface being at the top of annular bead or the centering surface forms an annular groove in the first shell.

According to yet another advantageous embodiment of the present application, the centering surface is less than 30 mm from the flange of the first shell, preferably less than 20 mm, more preferably less than 5 mm or possibly the centering surface and the flange of the first shell are contiguous.

According to yet another advantageous embodiment of the present application, the cut-outs have a closed outline in the flange or an open outline on the free edge of the flange.

According to yet another advantageous embodiment of the present application, the centering member is radially some distance away from the profile of the cut-outs of the flange of the first shell.

According to yet another advantageous embodiment of the present application, the centering surface and the centering member is machined by turning.

According to yet another advantageous embodiment of the present application, the cross-section of the centering member is generally curved, and the cut-outs are wider than the centering member in a circumferential direction.

According to yet another advantageous embodiment of the present application, the centering member includes contact surfaces designed to contact the centering surface.

According to yet another advantageous embodiment of the present application, each contact surface is angled at more than 5°, preferably more than 15°, even more preferably more than 30° to the circumference of the flange of the first shell.

This feature improves the strength imparted to each contact surface. Thus, the radial dimensions of the centering member can be reduced, as can the thickness of the shells. Ultimately, the dimensions of the flanges can be reduced. The angle in question is measured in the plane of the flange relative to the central axis of the shells.

According to yet another advantageous embodiment of the present application, the shells are fixed to each using fastening members on the flanges of the first and second shells, between the cut-outs on the flange of the first shell.

According to yet another advantageous embodiment of the present application, the flanges of the first and second shells have equal outer radii R3.

According to yet another advantageous embodiment of the present application, in combination, the centering member physically covers more than 10% of the circumference of the second shell, preferably more than 30%, even more preferably more than 50%.

According to yet another advantageous embodiment of the present application, the housing is a stator housing of a turbine or a compressor.

According to yet another advantageous embodiment of the present application, the compressor is a low-pressure compressor.

According to yet another advantageous embodiment of the present application, the shells are made of metal or a composite material.

According to yet another advantageous embodiment of the present application, the first and second shells are each formed integrally.

According to yet another advantageous embodiment of the present application, the shells are essentially the same diameter and the same thickness.

According to yet another advantageous embodiment of the present application, the shells are a surface of revolution with a curved profile.

According to yet another advantageous embodiment of the present application, at the centering member the base of the cut-outs is radially recessed in relation to the centering surface.

According to yet another advantageous embodiment of the present application, the second shell is in planar contact with the radial flange.

According to yet another advantageous embodiment of the present application, the radius of the centering surface R2 is closer to the mean radius R1 of the first shell than the radius R3 of the extremities of the flanges.

The mean radius is the mean thickness of the tube formed by the first shell.

According to yet another advantageous embodiment of the present application, the centering member is materially continuous from the second shell to the centering surface.

The present application also relates to an axial turbomachine including a turbofan, at least one compressor, at least one turbine in which the streams flow as directed by the housings, wherein at least one of the housings is in accordance with the present application.

The present application enables the radius of the flange to be reduced. The present application uses discontinuous centering taking advantage of the areas between the screws. This space allows positioning the two shells with respect to each other while reducing the radial size of the assembly. Thanks to this the reduction in radius substantial weight savings are possible.

The manufacturing processes required use standard tooling for shells. The precautions needed to ensure concentricity remain unchanged. The present application enables combined turning and milling operations to create the shapes for which the geometric tolerances are optimal. The machining processes are simple and require a reduced number of operations. Costs are moderate.

The outside diameter of a radial flange located in a splitter nose may be reduced. This feature means there need be no constraints on the design of the splitter nose. This may be thinned if necessary, for example to better serve a desired flow geometry.

The present application requires no spacers to achieve its compactness and precision. This feature means there are a small number of mechanical interfaces. The effects of mechanical play are reduced and the associated metrology costs remain low.

In the following description, the terms inner and outer refer to a position relative to the axis of rotation of an axial turbomachine.

FIG. 1 shows an axial turbomachine. In this case it is a double-flow turbojet. The turbojet 2 comprises a first compression stage, a so-called low-pressure compressor 6, a second compression stage, a so-called high pressure compressor 8, a combustion chamber 10 and one or more turbine stages 12. In operation, the mechanical power of the turbine 12 transmitted through the central shaft to the rotor 14 drives the two compressors 6 and 8. Reduction mechanisms may increase the speed of rotation transmitted to the compressors. Alternatively, the different turbine stages can each be connected to compressor stages through concentric shafts. These latter comprise several rotor blade rows associated with stator blade rows. The rotation of the rotor around its axis of rotation 16 generates a flow of air and gradually compresses it up to the inlet of the combustion chamber 12.

An inlet fan, commonly designated a "turbofan" 18, is coupled to the rotor 14 and generates an airflow which is divided into a primary flow 20 passing through the various above-mentioned levels of the turbomachine, and a secondary flow 22 passing through an annular conduit (shown in part) along the length of the machine and then rejoining the main flow at the turbine outlet. The primary flow 20 and secondary flow 22 are annular flows and are channeled through the casing of the turbomachine. To this end, the housing has cylindrical walls or shells that can be internal or external. These shells can be fitted at the turbofan 18, compressors (6, 8) between the compressors, at a turbine 12 or between the turbines.

Figure 2:
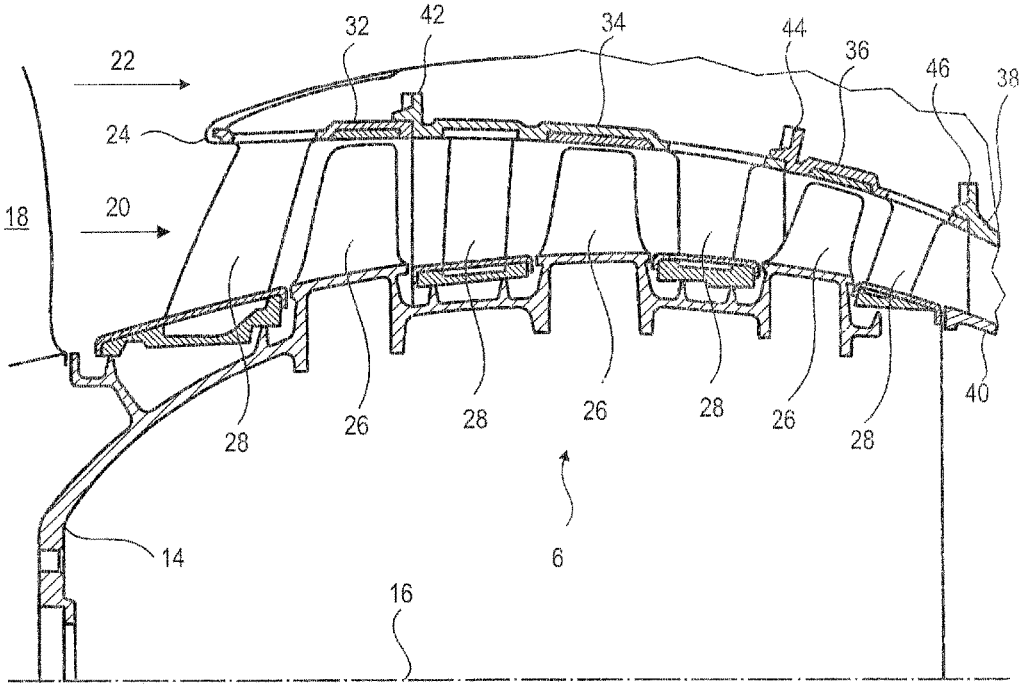
FIG. 2 shows a diagram of a turbomachine compressor according to the present application.

FIG. 2 is a sectional view of a low-pressure compressor 6 of an axial turbomachine 2 such as that of FIG. 1. Part of the turbofan 18 can be seen, as can the splitter nose 24 between the primary 20 and secondary 22 airflows. The rotor 14 comprises several rows of rotor blades 26, for example three, and several rows of stator blades 28, for example four. Each row of stator blades 28 is associated with a row of rotor blades 26 for straightening the airflow so as to convert the velocity of the flow into pressure. Each pair of rotor blade rows with the associated stator form a stage of the compressor 6.

The housing comprises annular surfaces which delimit the interior and exterior of the primary stream 20. The housing delimits the outside of the primary flow along the length of the low pressure compressor 6, and also the inside and outside between the compressors (6, 8).

The housing includes several shells (32, 34, 36, 38, 40). The housing may include, for example, a first external or upstream shell 32 that is located at the front and which, for example is contact with the splitter nose 24. It can be connected to the first row of stator blades. The housing may include a second outer or central shell 34. This can be connected to the stator vanes 28 of the second and third stage of the compressor 6. The housing may include a third outer or downstream shell 36. This may be in contact with the blades of the final compressor stage. It can be connected to an outer connecting shell 38, guiding the primary flow 20 to the compressor in combination with an internal shell 40.

According to an alternative of the present application, the second shell may be formed of a plurality of axial shell sections. This alternative can be advantageous when the compressor has more than four rows of stator blades. Alternatively, the first shell and the third shell may each be connected to more than one row of stator blades.

The shells are attached to each other at junctions (42, 44, 46) with radial flanges. Fixing members such as screws can be inserted into axial holes. The radial flanges are formed on at least one axial end of the shells. Preferably, the second shell is fixed by means of two radial flanges: an upstream one and a downstream one. Some of the shells are connected to structural parts of the turbomachine 2 by their radial flanges. Preferably, an axial assembly of shells is essentially fixed to the structural parts of the turbomachine using the radial flanges at the extremities of the assembly.

The shells comprise a tubular body formed by a tubular wall. The shells generally are circularly symmetrical, with profiles of revolution about axes of revolution. Preferably, the axes of revolution coincide with the axis 16 of rotation. Their profiles can be arched or angled. The wall thickness is less than 5.00 mm, preferably less than 3.00 mm, even more preferably less than 1.50 mm. The shells are preferably made of titanium.

Each shell may comprise angular sectors of the outer shell, each defining a part of a perimeter of the outer shell. These angular sectors are joined axially, for example by means of axial screwed flanges.

The shells can be used to fix the stator blades 28. They can be fixed by welding or screwing. The shells form walls designed to guide the flow in the turbomachine. They are preferably sealed. In combination they form a continuous sealed surface to achieve a high compression ratio. Locally, holes may be provided for tapping off air into the stream, or for injecting it. The shells may have annular grooves for housing layers of abradable material.

Figure 3:
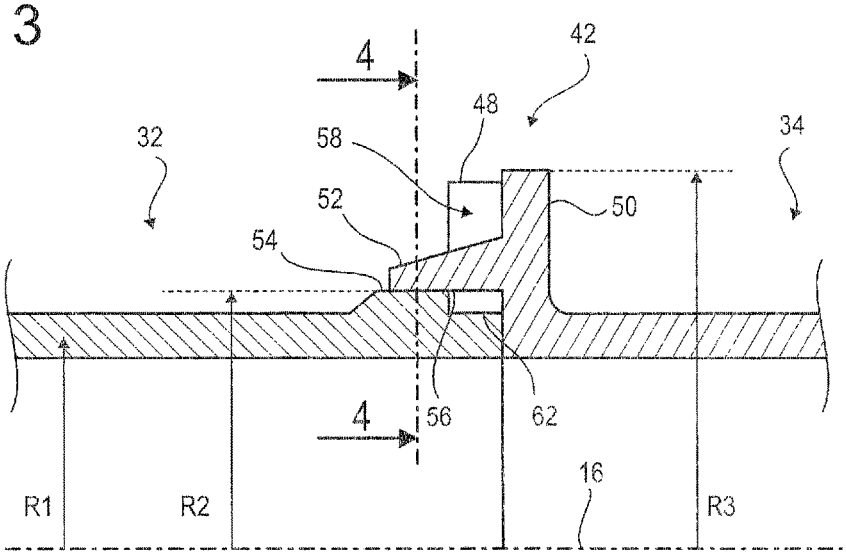
FIG. 3 illustrates a junction between two housing shells in accordance with a first embodiment of the present application.

FIG. 3 is a junction between two adjacent shells, such as the junction 42 between the first shell 32 and the second shell 34. The first shell 32 has a radial flange called the first flange 48. Preferably, the second shell has a second radial flange 50. Each of the radial flanges has a planar bearing surface which is perpendicular to the axis of rotation 16 of the turbomachine 2. The bearing surfaces enable a planar joint to be made. These bearing surfaces are used to align the two shells with respect to each other and, in particular, to enable their axes of revolution to be parallel. The radial flanges (48, 50) are extensions of the bodies of the shells and are in continuous contact, so as to ensure the junction between them is sealed.

To ensure the positioning of the shells (32, 34) in the plane of their flanges (48, 50), the second shell 34 has a radial centering member 52 engaging with complementary centering member. Additional centering members may include a centering surface 54 or reference surface. The centering surface 54 is generally cylindrical and coaxial with the first sleeve. The centering member comprises contact surfaces 56 being in contact with the centering surface 54.

The centering member 52 is in contact with the centering surface 54 on at least three unaligned points. Preferably, the centering member 52 is in contact with the centering surface 54 on at least two separate surfaces, preferably distributed around the circumference of the centering surface.

The centering surface 54 is formed by turning so as to provide optimum cylindricity and adequate perpendicularity with the plane of the first flange 48. The first flange 48 has cut-outs 58 that are the full depth of the material. The cut-outs 58, which may be straight-sided or wave-shaped, extend radially into the first flange 48. In order to reduce the outside radius R3 of the flanges of the shells, the centering member 52 is moved closer to the axis 16 and pass through the cut-outs. The centering surface 54 is located at the base of the first flange 48, opposite the second shell with respect to the first flange 48.

To ensure that the contact surfaces 56 are substantially in abutment against a reference surface having a defined shape, in particular the centering surface 54 which is formed by turning, the bases 62 of the voids of the cut-outs 58 are radially recessed relative to the centering surface 54. An arched tunnel is bounded by the bottom 62 of the cut-outs 58 and the centering member 52.

Figure 4:
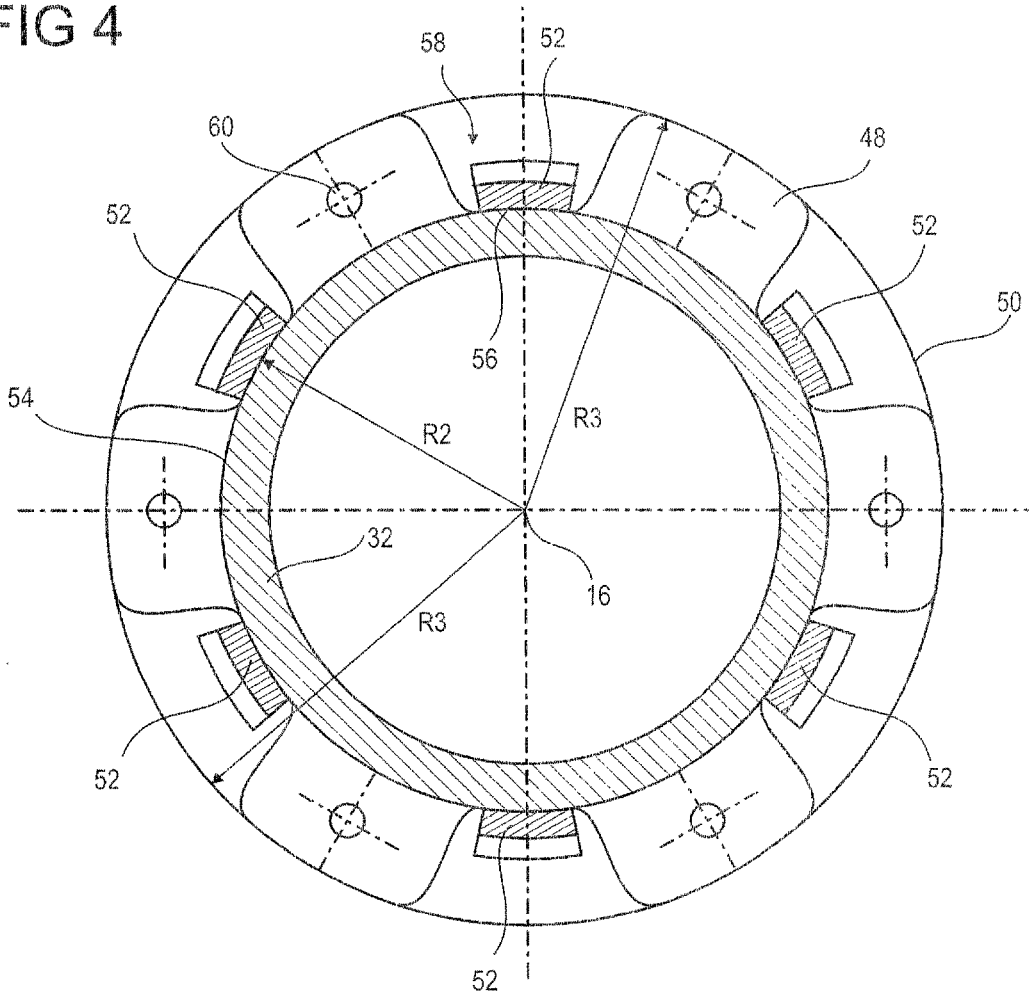
FIG. 4 shows a section of the junction between two shells of the housing of FIG. 3 sectioned at 4-4 in accordance to the first embodiment of the present application.

FIG. 4 is a sectional view of the first shell and the second shell sectioned along 4-4 in FIG. 3. This section passes through the interface between centering member 52 and the centering surface 54.

The centering member 52 is discontinuous in order to fit into the cut-outs 58 between the residual portions of the first flange 48. Their cross-sections correspondent to curved segments.

The centering member 52 contains the secondary contact surfaces 56 which are made by turning. This embodiment can benefit, from a shape standpoint, from the same advantages as the centering surface 54. The reference and contact surfaces (54, 56) are complementary. Preferably, the contact surfaces are located on the angled portions of the tube. When the contact and centering surfaces are fitted, they allow precise positioning and concentricity between the shells. Concentricity is less than 0.10 mm, preferably less than 0.05 mm, even more preferably less than 0.02 mm. This fitting takes advantage of the mating accuracy between a shaft and a bore.

The fixing members are arranged in the residual parts of the first flange 48. They pass through fixing holes 60 passing through both flanges. The required clearance around the fastening member does not conflict with the centering member 52 as they are offset tangentially. Therefore, the radial thickness of the centering member can be increased regardless of the configuration of the centering member. This increased thickness can strengthen the junction between the two shells (32, 34).

The present application is particularly suitable for an external junction between two shells of the low-pressure compressor 6. The mechanical strength of flanges thus produced is consistent both with the pressure of the primary flow as well as the thermal stress, vibration and shock to which a low pressure compressor can be subjected.

Figure 5:
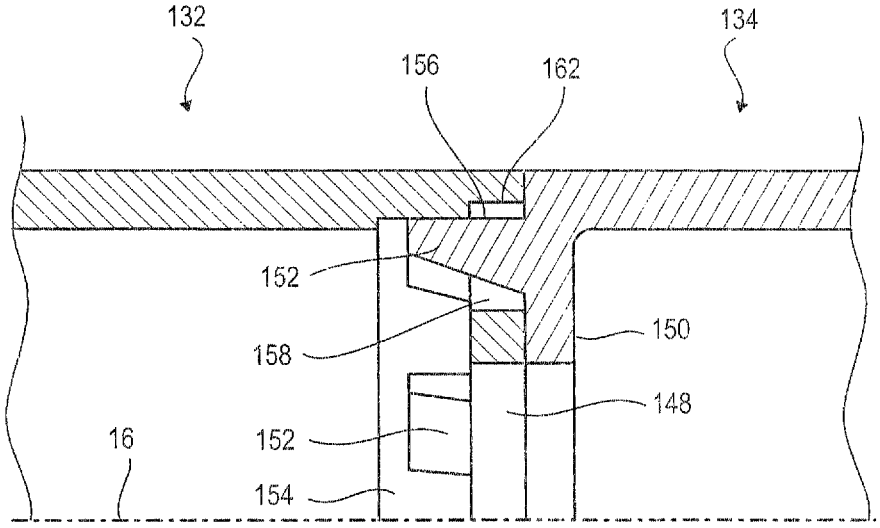
FIG. 5 illustrates a junction between two housing shells in accordance with a second embodiment of the present application.

FIG. 5 shows a junction between two shells in accordance with a second embodiment of the present application. FIG. 5 has the same numbering scheme as in previous figures for the same or similar elements, but the numbering is incremented by 100.

The shells (132, 134) may be located at the turbofan 18 and define a secondary flow. The shells can be internal shells defining the outside of the secondary flow. They have radial flanges extending inwardly toward the axis of rotation 16 of the turbomachine. They are located at the junction between the two shells (132, 134).

The first sleeve 132 has a first radial flange 148 which has a cut-out 158 that is the full depth of the material. This latter may be an opening whose contour is included in that of the first radial flange 148. The inner material continuity is advantageous for stiffening the first flange and hence the junction between the shells. The free extremity of the first flange essentially describes a circle.

The first shell also has a centering surface 154 oriented in the radial direction of the first radial flange 148. This surface is located in the thickness of the first shell 132. It is generally cylindrical. It forms a reduction in the thickness of the first shell 132. The bottom of the cut-out 162 is raised relative to the centering surface 154. At this point, the first shell 132 is even thinner than at the centering surface 154.

The second shell 134 has a second radial flange 150 on which are located the centering member 152. They have contact surfaces 156 matching the centering surface 154. The centering member 152 passes through the cut-outs until they reach the centering surface 154. On the first radial flange 148 the centering member 152 has a thickness less than that of the openings so as to be substantially in radial contact with the centering surface 154.

One skilled in the art can easily reverse the orientation of the technical features that have an orientation towards the inside or outside. The technical features of a shaped cut-out opening can be applied to a radially outwardly directed flange, as can a centering surface located in the body of a shell.

The invention claimed is:

1. An axial turbomachine housing suitable for channeling an annular flow therein comprising:

a first shell comprising a flange and a substantially cylindrical centering surface; and a second shell contiguous and coaxial with the first shell, the second shell comprising a flange and a centering member designed to mate radially with the centering surface;

wherein the flange of the first shell comprises cut-outs distributed along the circumference thereof and the centering member extends axially from the flange of the second shell through the cut-outs to the centering surface where the two flanges are in contact.

2. The housing in accordance with to claim 1, wherein the cut-outs of the flange of the first shell are wave-shaped.

3. The housing in accordance with to claim 1, wherein the cut-outs of the flange of the first shell are openings.

4. The housing in accordance with claim 1, wherein the axial extension of the cut-outs intersects the centering surface.

5. The housing in accordance with claim 1, wherein the centering surface forms a thickened layer on the first shell.

6. The housing in accordance with claim 1, wherein a radius R2 of the centering surface is smaller than a radius R3 of the radial extremity of the flange on the first shell.

7. The housing in accordance with claim 1, wherein the first shell, includes an annular bead adjacent to the flange of the first shell, the centering surface being at the top of the annular bead or the centering surface forming an annular groove in the first shell.

8. The housing in accordance with claim 1, wherein the cut-outs have a closed shape in the flange.

9. The housing in accordance with claim 1, wherein the cut-outs have an open shape at the edge of the flange.

10. The housing in accordance with claim 1, wherein the centering member is radially remote from the profile of the cut-outs in the flange of the first shell.

11. The housing in accordance with claim 1, wherein the centering surface and the centering member are machined by turning.

12. The housing in accordance with claim 1, wherein the cross section of the centering member is generally curved, and the cut-outs are wider than the centering member in a circumferential direction.

13. The housing in accordance with claim 1, wherein the centering member comprises:

contact surfaces designed to contact the centering surface.

14. The housing in accordance with claim 1, wherein the shells are fixed to each other by fastening members on the flanges on the first and second shells, between the cut-outs on the flange of the first shell.

15. The housing in accordance with claim 1, wherein the flanges of the first and second shells have an equal outer radii R3.

16. The housing in accordance with claim 1, wherein the centering member physically covers more than 10% of the circumference of the second shell.

17. The housing in accordance with claim 1, wherein the centering member physically covers more than 30% of the circumference of the second shell.

18. The housing in accordance with claim 1, wherein the centering member physically covers more than 50% of the circumference of the second shell.

19. An axial turbomachine, comprising:

a turbofan;

at least one compressor;

at least one housing comprising:

a first shell comprising a flange and a substantially cylindrical centering surface; and a second shell contiguous and coaxial with the first shell, the second shell comprising a flange and a centering member designed to mate radially with the centering surface;

wherein the flange of the first shell comprises cut-outs distributed along the circumference thereof and the centering member extends axially from the flange of the second shell through the cut-outs to the centering surface where the two flanges are in contact; and at least one turbine in which streams flow as directed by the housing.

* * * * *